US005845447A

United States Patent [19]

Bodine et al.

[11] Patent Number: 5,845,447

[45] Date of Patent: Dec. 8, 1998

[54] SUSPENSION CEILING SYSTEM

[75] Inventors: Darryl C. Bodine, Lancaster; William C. Dorsey, Conestoga, both of Pa.

[73] Assignee: Armstrong World Industries, Inc., Lancaster, Pa.

[21] Appl. No.: 839,126

[22] Filed: Apr. 23, 1997

[51] Int. Cl.[6] ..... E04B 2/00

[52] U.S. Cl. ..... 52/506.09; 52/764; 52/716.4

[58] Field of Search ..... 52/506.07, 506.08, 52/506.06, 474, 489.1, 489.2, 506.09, 764, 773, 774, 716.7, 716.6, 716.4, 718.04

[56] References Cited

U.S. PATENT DOCUMENTS

| | | | |
|---|---|---|---|
| 1,854,938 | 4/1932 | Wray | 52/506.09 |
| 1,997,581 | 4/1935 | Heeren et al. | 52/506.09 |
| 2,059,483 | 11/1936 | Parsons | 72/118 |
| 2,710,081 | 6/1955 | Fink | 189/85 |
| 2,921,656 | 11/1960 | Goyer | 52/506.09 |
| 2,973,703 | 3/1961 | Jack | 52/506.09 X |
| 3,082,487 | 3/1963 | Fowler et al. | 52/506.09 X |
| 3,228,163 | 1/1966 | Lindstrom | 52/506.09 |
| 4,112,550 | 9/1978 | DeWitt et al. | 24/73 |
| 4,452,021 | 6/1984 | Anderson | 52/311 |
| 4,463,537 | 8/1984 | Rodriquez et al. | 52/489 |
| 4,520,607 | 6/1985 | Suckow | 52/489 |
| 4,640,064 | 2/1987 | Goodworth, II | 52/145 |
| 4,848,054 | 7/1989 | Blitzer et al. | 52/488 |
| 5,579,624 | 12/1996 | Aeberhard | 52/773 X |

FOREIGN PATENT DOCUMENTS

| | | | |
|---|---|---|---|
| 636411 | 3/1962 | Italy | 52/506.09 |

*Primary Examiner*—Creighton Smith

[57] ABSTRACT

A suspended ceiling system has a plurality of ceiling panels, ceiling runners, and a plurality of clips holding the ceiling panels to the ceiling runners. Each ceiling panel has two opposed surfaces and four sides with at least two sides having an extended edge each of which are substantially perpendicular to one of the opposed surfaces. Each extended edge has a protruding lip. The length of the protruding lip is limited so that the protruding lip does not extend for the entire length of the extended edge.

12 Claims, 3 Drawing Sheets

SUSPENSION CEILING SYSTEM

BACKGROUND OF THE INVENTION

Field of the Invention

This invention relates to a suspended ceiling system having ceiling panels, T-bar shaped beams (ceiling runners) joined to create a grid, and clips which can be attached to the grid for holding the ceiling panels thereto. Advantageously, the clips of the present invention allow the easy removal of the ceiling panels. In addition to this, the clips can also be easily attached to or removed from the grid.

Systems of suspended ceiling panels have been popular for both commercial and residential buildings. These systems allow the installation of a ceiling which can be acoustically absorbent and is aesthetically pleasing. These ceiling systems, moreover, can be quickly and easily installed. The ceiling systems are particularly desired for hiding pipes, wiring, and duct systems that are common in many buildings.

Suspension ceilings having a variety of different features directed to the attachment of ceiling panels to a ceiling grid have been developed. One suspension ceiling system is disclosed in U.S. Pat. No. 4,640,064. This system combines snap-up pans and lay-in panels. The system includes runners formed with channels formed by opposed lateral flanges, depending side walls and inturned lips. Yet another system is described by U.S. Pat. No. 2,059,483 which requires a channel bar and clips which are inserted into the channel of the channel bar. The clips are attached to building panels which are thereby held to the channel bar. U.S. Pat. No. 4,463,537 describes a suspended ceiling or wall system employing clips fabricated to permit the semi-permanent attachment of the individual clips to a suspended grid tee system. The system contains a clip leg with extruded wands angling therefrom for frictionally coupling decorative molding thereto. The molding system, in turn, supports a plurality of decorative plaques.

U.S. Pat. No. 4,463,537 describes a clip for suspending ceiling panels. The clip, at one end, attaches to the ceiling panel, and at the other end, has a hook element for removably attaching to an existing ceiling panel grid.

Even though there is a variety of suspended ceiling systems there is still a need for a suspended ceiling system which provides easily removable panels which can also be easily attached to the ceiling runner grid system. In addition to this, for cosmetic purposes, the ceiling system should preferably not show any part of the ceiling runners after the suspended ceiling has been installed. The present invention provides such a ceiling system.

DECRIPTION OF THE INVENTION

A suspended ceiling system has a plurality of ceiling panels, ceiling runners, and a plurality of clips holding the ceiling panels to the ceiling runners. Each clip has an upper portion and a lower portion. The upper portion attaches to the ceiling runner and the lower portion holds the panel.

Each ceiling panel has two opposed surfaces and four sides with at least two sides having an extended edge each of which are substantially perpendicular to and extends beyond one of the opposed surfaces. Each extended edge has a protruding lip. The length of the protruding lip is limited so that the protruding lip does not extend for the entire length of the extended edge.

In the ceiling runners the lowest portion has a flange with two opposed edges. The upper portion of each clip has a means to attach the clip to the flange of the ceiling runner provided, however, that after the clip is attached, said clip can slide and move along the flange of the runner to which said clip is attached. The lower portion of each clip has two opposed, protruding members which are substantially perpendicular to the flange of the runner when the clip is attached. At least one of the protruding members has a groove shaped to receive the protruding lip of the ceiling panel. The protruding members of the clip are set far enough apart to allow the extended edge of at least one ceiling panel to be inserted between the members with the protruding lip on the extended edge of the panel fitting into the groove on the protruding member of the clip to thereby fix the ceiling panel to the clip attached to the ceiling runner.

Preferably, each panel can be removed from the ceiling runner by forcibly pulling it loose from the clips holding it to the runner. More preferably, since each clip can move on the runner, each ceiling panel can be removed by sliding each clip on the panel away from the protruding lip on the extended edge of the panel and allowing the panel to drop away from the clips and runners. If removal of the panels is necessary, it is preferred to achieve this removal by moving the clips on the runner in order to avoid the danger of damaging the clips with the forcible removal.

In preferred embodiments, each of the two opposed, protruding members will have a groove to receive the protruding lip. The groove on the protruding member of the clip faces the groove of the opposed protruding member. The protruding members are set far enough apart to allow the extended edge of two ceiling panels to be inserted and held by putting the protruding lip in the groove of the clip. The panel is thus held between the members.

When the ceiling panels are inserted, the two ceiling panels should be placed evenly together with the extended edge of one ceiling panel being adjacent to and touching the extended edge of the other ceiling panel, the extended edges of the panels being substantially perpendicular to the flange of the runner. When the extended edges of the ceiling panels are inserted between the members, the protruding lip of each panel fits into the groove on a protruding member of the clip, to fix the two ceiling panels to the ceiling runner.

In other preferred embodiments, the flange on the runner forms one lower surface of the runner, and the means to attach the clip to the ceiling runner is an indentation substantially as wide as the lower surface of the runner to which the clip attaches. The indentation further is deep enough to fit over each edge of the flange of the runner, the indentation being between two grooved lips which extend along the entire length of the clip on the first part of the clip which is fixed to the runner. The grooved lips allow the clip to snap onto each edge of the flange of the runner with the groove of each lip fitting over the flange of the runner and holding the clip to the runner and also allowing the clip to slide along the length of the runner.

DETAILS OF THE INVENTION

Suitably the individual ceiling panels could be pulled loose from the clips holding them, but a more preferred method of removing the panels is to slide the clips holding the panel away from each protruding lip (3) being held by the groove (7) of the clip.

The clips provide a sufficient amount of pinch strength to hold a single panel in place in the suspension ceiling.

If desired, the clips can be extruded using a polymer such as polyvinyl chloride (PVC). In such a case, the polymer clips would advantageously be light in weight. The ceiling runners (also referred to as grid bars) can be made of metal or a polymer such as PVC. The ceiling panel can be made of conventional materials such as wood, metal, or polymer such as PVC.

Figure 6:
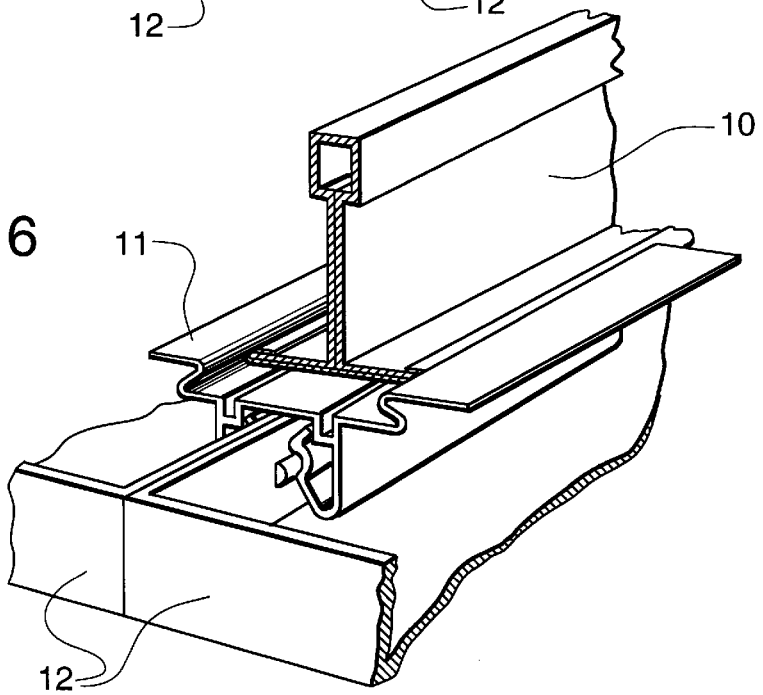
FIG. 6 shows a fragmentary perspective view of the assembled elements (ceiling runner (10) in clip (11) which holds two ceiling panels (12)). The clip (11) is capable of moving on the ceiling runner. The flange (4) of the ceiling runner fits in the clip so that the grooves (8) and the lips (9) hold the ceiling runner. In preferred embodiments the clip is sufficiently loose to allow the clip to slide along the ceiling runner and away from the protruding lip (3).

FIG. 6 shows the preferred embodiment where the clip (11) has a groove (7) on each of the protruding members (6) and each side of the ceiling panel has an extended edge (2). The protruding members are set far enough apart to allow the extended edge of two ceiling panels to be inserted snugly between the members. When the ceiling panels are inserted, the two ceiling panels are preferably placed evenly together with the extended edge (2) of one ceiling panel being adjacent to and touching the extended edge of the other ceiling panel. The extended edges of the panels are substantially perpendicular to the flange of the runner, and when the extended edges of the ceiling panels are inserted between the members, a protruding lip on each panel fits into the groove (7) on the protruding member (6) of the clip to fix the two ceiling panels to the ceiling runner.

Figure 1:
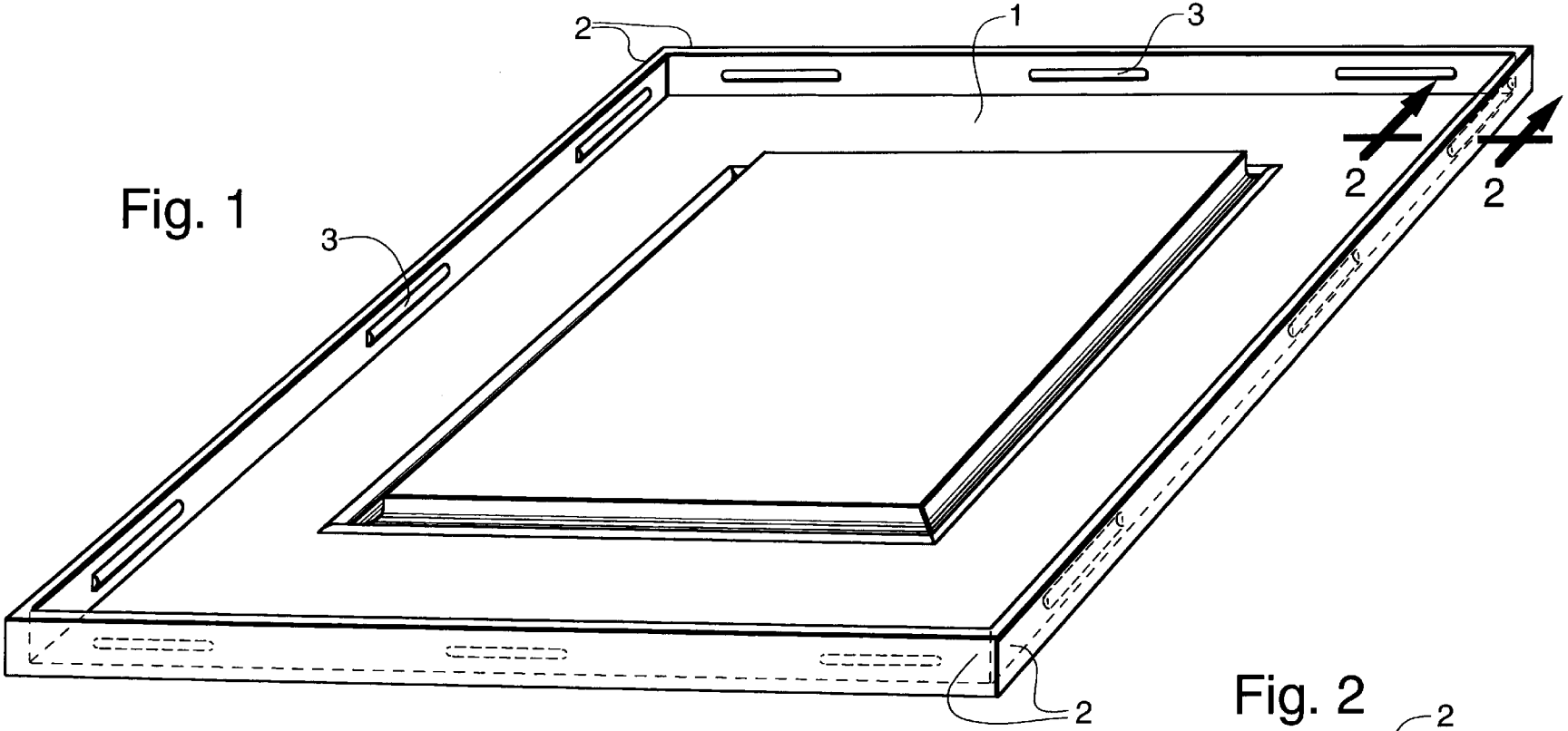
FIG. 1 is a perspective of a ceiling panel. In this view, the surface (1) of the ceiling panel which faces up toward the ceiling is shown. On each of the four sides of the panel there is an extended edge (2). On each extended edge the protruding lip can be noted. In fact, in this figure, each extended edge has the preferred three protruding lips.
Figure 2:
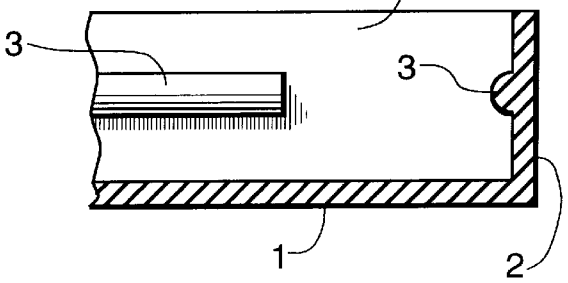
FIG. 2 is an enlarged fragmentary sectional view of the panel taken on the line 2—2 of FIG. 1. A protruding lip (3) is seen on each of the two edges (2) of the panel.
Figure 3:
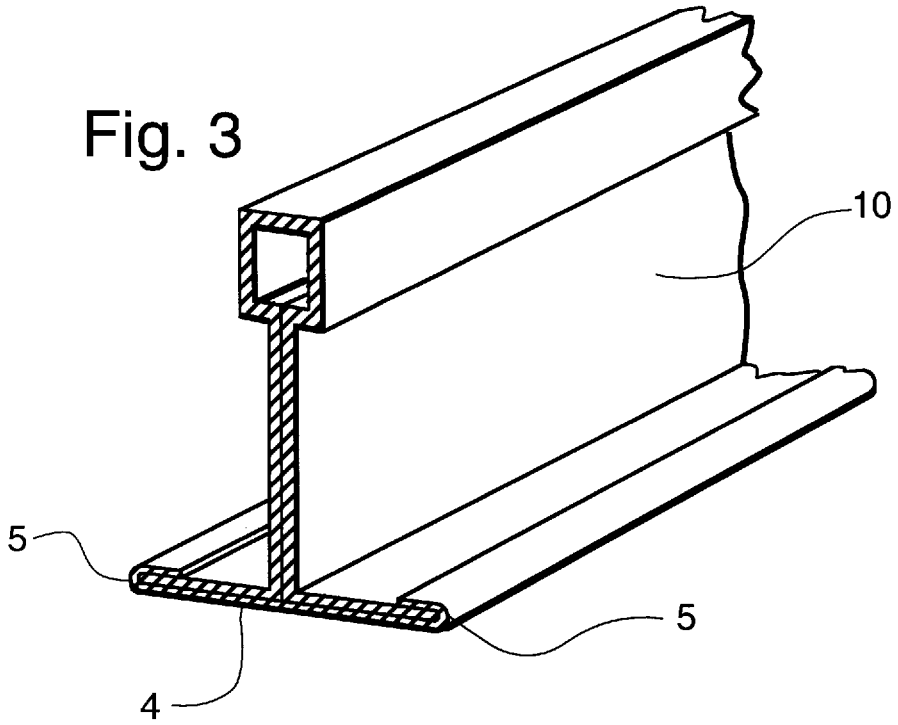
FIG. 3 shows a ceiling runner. The flange (4) of the ceiling runner is seen, the flange having two opposed edges (5).
Figure 4:
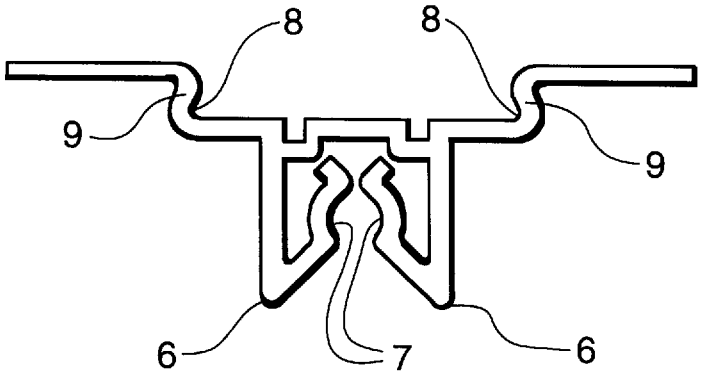
FIG. 4 is an enlarged end view of a clip which attaches to the flange (4) of the ceiling runner (FIG. 3). Two protruding members (6) are seen on the clip. These protruding members will be substantially perpendicular to the flange of the ceiling runner when the clip is attached to the runner. Each protruding member has a groove (7). One protruding lip (3) on a ceiling panel fits into the groove (7). The upper portion of the clip is indented to receive the flange (4). The clip has a lip (9) on each side of the clip, thus forming the indentation. Each lip (9) has a groove (8) which will receive an edge (5) of the ceiling runner. The indentation formed between lips (9) is wide enough to receive the flange (4).
Figure 5:
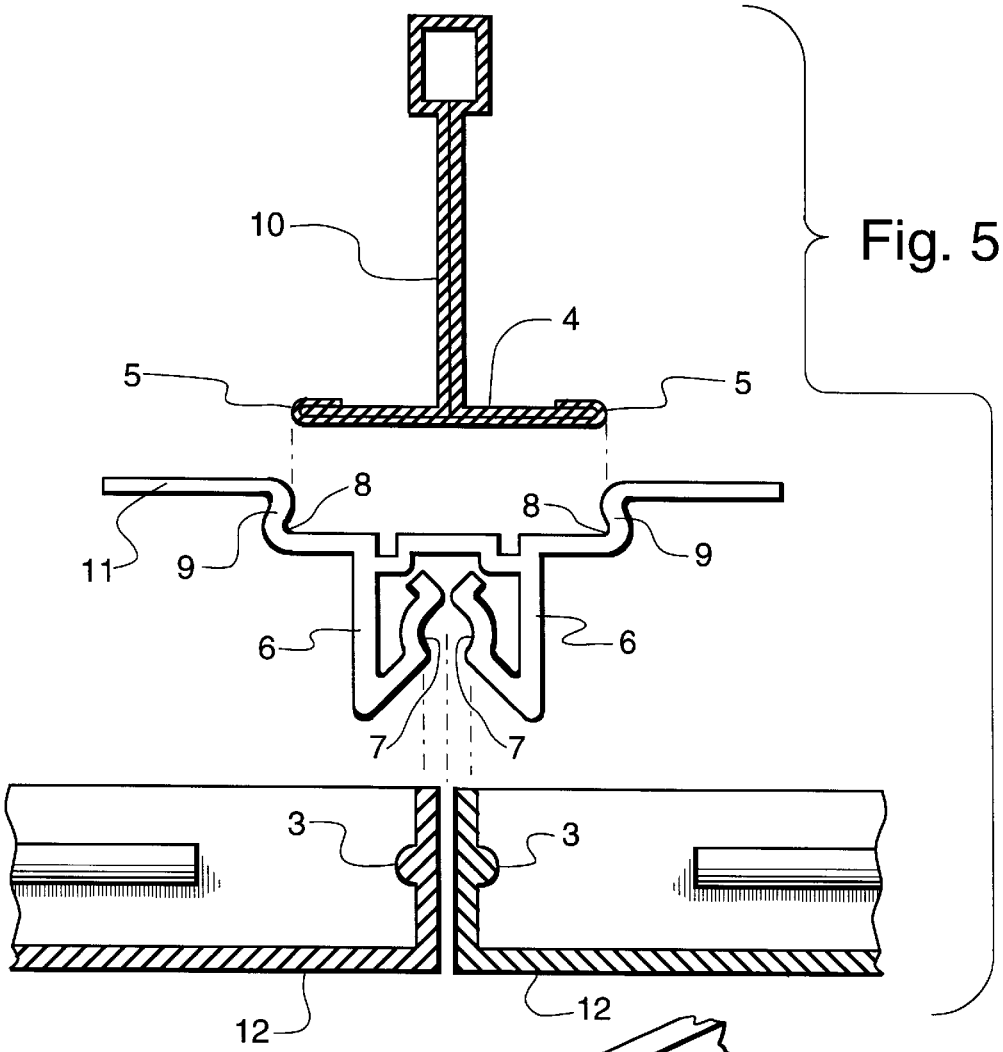
FIG. 5 is a vertical, sectional, exploded view of the ceiling runner (10), a clip (11), and a ceiling panel (12) as all pieces come together. It is seen that two ceiling panels are being inserted upward so that each protruding lip (3) will be inserted into a groove (7) on the protruding member (6) of the clip. The clip also has two lips (9) each of which have a groove (8), the groove (8) and the lips (9) having an indentation between the lips. The indentation will receive the ceiling runner's flange (4). Each edge (5) of the flange (4) fits into the groove (8) of the clip (11) and the flange (4) fits into the indentation formed between lips (9) of the clip.

The flange on the runner forms one lower surface of the runner, and a preferred means to attach the clip to the ceiling runner is an indentation substantially as wide as the lower surface of the runner to which the clip attaches. In FIG. 4, the preferred indentation is shown between the lips (9) which have the grooves (8) which receive the edges (5) of the ceiling runner. The indentation is deep enough to fit over each edge (5) of the flange (4) of the runner, the indentation being between two grooved lips which extend along the entire length of the clip on the first part of the clip which is fixed to the runner. The grooved lips further allow the clip to snap onto each edge of the flange of the runner with the groove of each lip fitting over the flange of the runner and holding the clip to the runner and also preferably allowing the clip to slide along the length of the runner.

I claim:

1. A suspended ceiling system comprising:

a) a plurality of ceiling panels;

b) a plurality of clips;

c) ceiling runners having a flange with two opposed edges;

d) each said ceiling panel having a surface and four sides where at least two sides have an extended edge each of which are substantially perpendicular to and extends beyond the surface and each extended edge has a protruding lip, with a length which is limited so that said protruding lip does not extend along all of the extended edge;

e) with the clip having a means to attach the clip to the flange of the ceiling runner provided, however, that after the clip is attached to the flange, said clip is slidable and movable along the flange of the runner to which said clip is attached, and each clip having two opposed, protruding members which are substantially perpendicular to the flange of the runner when the clip is attached to the flange, further providing that at least one of the protruding members has a groove shaped to receive the protruding lip; and f) the protruding members of the clip are set far enough apart to allow the extended edge of at least one ceiling panel to be inserted between the members with the protruding lip on the extended edge of the panel fitting into the groove on the protruding member of the clip to thereby fix the ceiling panel to the clip attached to the ceiling runner.

2. A suspended ceiling system as described in claim 1 wherein each ceiling panel is removable removed from the ceiling system by sliding each clip on the panel along the ceiling runner and away from the protruding lip on the extended edge of the panel and allowing the panel to drop away from the clips and runners.

3. A suspended ceiling system as described in claim 1 wherein further each ceiling panel is removable from the suspended ceiling system by forcibly pulling the panel out of each clip.

4. The suspended ceiling system of claim 1 wherein all four sides of each ceiling panel have an extended edge.

5. A suspended ceiling system which comprises:

a) a plurality of ceiling panels;

b) a plurality of clips;

c) ceiling runners having a flange with two opposed edges;

d) each said ceiling panel having a surface and four sides where at least two sides have an extended edge each of which are substantially perpendicular to and extends beyond the surface and each extended edge has a protruding lip, with a length which is limited so that said protruding lip does not extend along all of the extended edge;

e) each said clip having a means to attach the clip to the flange of the ceiling runner, provided, however, that after the clip is attached to the flange, said clip is slidable and movable along the flange of the runner to which said clip is attached, each clip further having two opposed, protruding members which are substantially perpendicular to the flange of the runner when the clip is attached, further providing that each of the opposed protruding members has a groove shaped to receive the protruding lip, and each groove in the protruding member of the clip faces the groove of the opposed protruding member; and f) the opposed, protruding members of the clip are set far enough apart to allow the extended edge of two ceiling panels to be inserted snugly between the members, further providing that when the ceiling panels are inserted, the two ceiling panels are placed evenly together with the extended edge of one ceiling panel being adjacent to and touching the extended edge of the other ceiling panel, the extended edges of the panels being substantially perpendicular to the flange of the runner, and when the extended edges of the ceiling panels are inserted between the members, the protruding lip on the extended edge of each panel fits into the groove on the protruding member of the clip, to fix the two ceiling panels to the ceiling runner.

6. The suspended ceiling system of claim 5 wherein all four sides of each ceiling panel have an extended edge.

7. A suspended ceiling system as described in claim 5 wherein each ceiling panel is removable from the ceiling system by sliding each clip on the panel along the ceiling runner and away from the protruding lip on the extended edge of the panel and allowing the panel to drop away from the clips and runners.

8. A suspended ceiling system as described in claim 5 wherein further each ceiling panel is removable from the suspended ceiling system by forcibly pulling the panel out of each clip.

9. A suspended ceiling system which comprises:

a) a plurality of ceiling panels;

b) a plurality of clips;

c) ceiling runners having a flange with two opposed edges;

d) each said ceiling panel having a surface and four sides where at least two sides have an extended edge each of which are substantially perpendicular to and extends beyond the surface and each extended edge has a protruding lip, with a length which is limited so that said protruding lip does not extend along all of the extended edge;

e) with the upper portion of said clip having a means to attach the clip to the flange of the ceiling runner, wherein the said means to attach the clip to the ceiling runner is an indentation on the clip, said indentation being substantially as wide as the lower surface of the runner to which the clip attaches, said indentation being between two grooved lips which extend along the clip, the indentation further being deep enough to fit over each edge of the flange of the runner and further that said grooved lips further allow the clip to snap onto each edge of the flange of the runner with the groove of each lip fitting over the flange of the runner and holding the clip to the runner and also allowing the clip to slide along the length of the runner after the clip is attached, said clip being slidable and movable along the flange of the runner to which said clip is attached, each clip further having two opposed, protruding members which are substantially perpendicular to the flange of the runner when the clip is attached to the flange, further providing that at least one of the protruding members has a groove shaped to receive the protruding lip, and f) the protruding members of the clip are set far enough apart to allow the extended edge of at least one ceiling panel to be inserted between the members with the protruding lip on the extended edge of the panel fitting into the groove on the protruding member of the clip to thereby fix the ceiling panel to the clip attached to the ceiling runner.

10. The suspended ceiling system of claim 9 wherein all four sides of each ceiling panel have an extended edge.

11. A suspended ceiling system as described in claim 9 wherein each ceiling panel is removable from the ceiling system by sliding each clip on the panel along the ceiling runner and away from the protruding lip on the extended edge of the panel and allowing the panel to drop away from the clips and runners.

12. A suspended ceiling system as described in claim 9 wherein further each ceiling panel is removable from the suspended ceiling system by forcibly pulling the panel out of each clip.

* * * * *